US007600705B2

(12) United States Patent
Castronovo

(10) Patent No.: US 7,600,705 B2
(45) Date of Patent: Oct. 13, 2009

(54) FEEDING MECHANISM AUTO-ADJUSTING TO LOAD FOR USE IN AUTOMATIC HIGH-SECURITY DESTRUCTION OF A MIXED LOAD, AND OTHER FEEDING SYSTEMS

(76) Inventor: Charles A. Castronovo, 706 Chapel Ridge Rd., Timonium, MD (US) 21093

( * ) Notice: Subject to any disclaimer, the term of this patent is extended or adjusted under 35 U.S.C. 154(b) by 621 days.

(21) Appl. No.: 11/181,779

(22) Filed: Jul. 15, 2005

(65) Prior Publication Data

US 2006/0016919 A1 Jan. 26, 2006

Related U.S. Application Data

(60) Provisional application No. 60/590,904, filed on Jul. 26, 2004.

(51) Int. Cl.

| | |
|---|---|
| ***B02C 4/32*** | (2006.01) |
| ***B02C 7/14*** | (2006.01) |
| ***B02C 9/04*** | (2006.01) |
| ***B02C 11/08*** | (2006.01) |

(52) U.S. Cl. ..... 241/35

(58) Field of Classification Search ..... 241/35, 241/222–225

See application file for complete search history.

(56) References Cited

U.S. PATENT DOCUMENTS

| | | | | |
|---|---|---|---|---|
| 2,556,653 | A * | 6/1951 | Kelso | 241/35 |
| 3,335,968 | A * | 8/1967 | Young | 241/35 |
| 3,958,737 | A | 5/1976 | Scott | |
| 4,621,798 | A | 11/1986 | Akers | |
| 4,804,148 | A * | 2/1989 | Etheridge | 241/35 |
| 5,230,475 | A | 7/1993 | Gerner | |
| 5,348,282 | A | 9/1994 | Choi et al. | |
| 5,622,330 | A | 4/1997 | Sharp et al. | |
| 5,833,150 | A * | 11/1998 | Koyanagi et al. | 241/27 |
| 5,901,535 | A * | 5/1999 | Duckinghaus et al. | 56/10.2 G |
| 6,293,479 | B1 * | 9/2001 | Kaczmarski et al. | 241/92 |
| 6,561,444 | B1 * | 5/2003 | Yokomine et al. | 241/30 |
| 6,938,844 | B2 | 9/2005 | Castronovo | |
| 2003/0201353 | A1 | 10/2003 | Lefrancois et al. | |

OTHER PUBLICATIONS

Chase/Great Buy U.S.A.—3-way Home & Office Cross Cut Shredder—Advertisement Dated Dec. 16, 2004.

* cited by examiner

*Primary Examiner*—Bena Miller
(74) *Attorney, Agent, or Firm*—Whitham Curtis Christofferson & Cook, PC

(57) ABSTRACT

A inventive feeding mechanism continuously feeds and continuously subjects to shredding, cutting, recycling, sorting, or other processing, a load consisting of a mixture of different-thickness materials, such as a mixture of paper, compact disks (CDs), cassette tapes, videotapes, etc. The auto-adjusting feeding mechanism is useable in high-security destruction, food processing, recycling, sorting, processing, and other applications.

23 Claims, 6 Drawing Sheets

FEEDING MECHANISM AUTO-ADJUSTING TO LOAD FOR USE IN AUTOMATIC HIGH-SECURITY DESTRUCTION OF A MIXED LOAD, AND OTHER FEEDING SYSTEMS

RELATED APPLICATION

This claims benefit of U.S. provisional application Ser. No. 60/590,904 filed Jul. 26, 2004 titled "Feeding mechanism auto-adjusting to load, for use in automatic high-security destruction of a mixed load, and other feeding systems."

FIELD OF THE INVENTION

The present invention generally relates to mechanized load-feeding and movement of a load.

BACKGROUND

It often is desired to feed a load (such as material to be destroyed, food to be shredded, etc.) towards a processing mechanism (such as a shredding mechanism, cutting mechanism, etc.). Conventionally, feeding mechanisms have been established for continuously moving materials within a certain range of dimensions towards the processing mechanism. For example, a load within a first range of thickness could be handled continuously, but the feeding mechanism would need to be stopped and manually adjusted before trying to feed a load of a second range of thickness.

It has long been commonly appreciated that care is usually required in feeding an input load into most machines as to proper orientation of pieces of the load, uniform quality of pieces of the load, etc. This has long been applicable for machines involving cutting and especially the specific case of paper shredders. It conventionally had been recognized that the operative cutting mechanisms in paper shredders were designed to accommodate a particular thickness of paper and that inputting too thick a stack of pages, for example, could damage or at least "stall" or jam the shredder. For accomplishing high-security destruction, in the past, each kind of material needing to be destroyed had a particular destruction mechanism designed to destroy the material based on its dimensions, kind of material, etc. Other than the present inventor's recent work being brought to the market, there has not yet been a destruction mechanism that would destroy paper to high-security small pieces as well as also destroy non-paper materials such as a polyester-type material (such as key tape), a thick material (such as a book), etc. Rather, conventionally no more was expected of a paper shredder than that it shred paper. Merely meeting the recent security requirements demanding yet smaller-sized residue has occupied the shredder industry, as most of the shredder industry seemingly has been unable to design products to satisfy the new high-security shredder requirements. Only a few companies have actually managed to do so with actual viable products in the marketplace.

In the case of an expensive category of machine called a disintegrator, paper shredding and different types of to-be-destroyed material ultimately may be accommodated. However, within the disintegrator machine the different materials may travel non-identical feed paths. See US 2003/0201353 A1 by Lefrancois et al., titled "Dual-path office product disintegrator" published Oct. 30, 2003. Different input ports are provided for different types of input materials. Disintegrators are heavy, large-dimensioned (non-portable) machinery. Several commercially-available disintegrators actually are two machines combined, in order to perform the destruction function. Typically, a conventional shredder is typically atop a conventional disintegrator. It pre-shreds paper (and some other materials), and then feeds the-pre-shredded material to the disintegrator. This is usually necessary to obtain adequate throughput rates.

In high-security destruction, before the present inventor's own work it had not been possible to destroy different to-be-destroyed materials in a single shredder or a single disintegrator. Thus, the question of feeding a significantly non-uniform load of to-be-destroyed material had not been encountered in the area of high-security destruction.

Examples of conventional feeding mechanisms are mentioned.

U.S. Pat. No. 3,958,737 issued May 25, 1976 to Scott (Precision Sales Corp.) for "Adjustable Feed Mechanism."

U.S. Pat. No. 5,622,330 issued Apr. 22, 1997 to Sharp et al. (ASC Machine Tools, Inc.) for "Self-adjusting Feed Stock Accumulator System."

U.S. Pat. No. 5,348,282 issued Sep. 20, 1994 to Choi et al. (Xerox Corp.) for "Self Adjusting Feed Roll."

U.S. Pat. No. 4,621,798 issued Nov. 11, 1986 to Akers (Bell & Howell Co.) for "Envelope Feeding Mechanism for Mail Sorting Machines."

SUMMARY OF THE INVENTION

A feeding mechanism has been invented to continuously feed and continuously subject to shredding, cutting or the like, a load consisting of a mixture of different-thickness materials, and different-material items, such as a mixture of paper, compact disks (CDs), cassette tapes, credit cards, "smart" cards, identification badges, videotapes, etc.

The present invention relating to feeding a non-uniform load was accomplished after the present inventor was the first to invent a processing station that, surprisingly, could perform high-security destruction of non-uniform material without stopping for manual adjustment of the destruction machinery and without a problem of the destruction mechanism jamming or the like. Namely, even if a single processing station can accomplish, without manual adjustment, high-security destruction of sheets of paper as well as boards or cassettes, a thicker load (for example) may heat-up the processing station so much that it could be desirable to slow the advance of such a thicker load to avoid, for example, generating a high temperature. When the present inventor was presented with that novel question of feeding a non-uniform load to a single high-security destruction motorized processing station, he invented novel feeding methods, systems, apparatuses, etc. in which the motorized processing station and feeding path are disposed in a relationship that is both separate from each other and non-manually controlled. Significantly, the present inventor has recognized that through separation of the feeding function from the processing function, advantages may be achieved. The present inventor has recognized the disadvantages of conventional shredders, in which the feed system is locked in rate (by gears or chains or a combination thereof) to the shredding system, and has inventively eliminated the need, in a paper shredder, for the feed system to be locked in rate to the shredding system.

The present invention reduces the number of different input openings and/or different feed paths needed in a machine when a non-uniform load is being fed toward a processing station. In a particularly preferred example, one processing station may accomplish high security destruction of a non-uniform load of to-be-destroyed material that arrives via a single feed path regardless of the type of material. For example, the present invention advantageously can be used to eliminate any need to feed paper sheets into one destruction machine but to feed plastic cards (such as SMART cards, credit cards, CD's DVD's, etc.) into another destruction machine. Also, the present invention advantageously can be used to eliminate the need to manually adjust or take special precautionary actions with certain destruction machines before feeding a different kind of to-be-destroyed material.

The invention in a preferred embodiment provides an auto-adjusting feeding system for feeding a non-uniform load towards a processing station (preferably a motor-driven processing station), wherein the load comprises a plurality of items wherein uniformity of the items is not required, comprising: (a) an undivided moving feed path along which the non-uniform items travel together; (b) an automatic measurement system wherein effect of the load on the processing station is measured without human operator intervention during feeding operation; and (c) an automatic adjustment system wherein during feeding operation feed of the load is adjusted without human operator intervention (such as, e.g., auto-adjusting feeding systems wherein the rate at which the load is fed towards the processing station is non-manually adjusted to be slower or faster based on a non-manual measurement of at least one characteristic of the load (such as, e.g., height, length, width, and/or weight)), such as, e.g., auto-adjusting feeding systems comprising a non-manual destruction-stage current measurement and feedback of that current measurement to non-manually control load feed; auto-adjusting feeding systems including non-manual reversal of the load feed in a non-feed direction away from the processing station; etc.

In another preferred embodiment, the invention provides a mechanical system comprising: a processing station; an auto-adjusting feeding system for feeding a non-uniform load towards the processing station, wherein the load comprises a plurality of items and uniformity of the items is not required, comprising: (a) an undivided feeding path along which the non-uniform items travel together; (b) an automatic measurement system wherein effect of the load on the processing station is measured without human operator intervention during feeding operation; and (c) an automatic adjustment system wherein during feeding operation, feed of the load is adjusted without human operator intervention.

The invention in another preferred embodiment provides an automatic destruction machine that processes a fed load, comprising: a feeding mechanism auto-adjusting to the load wherein feed is adjusted without human operator intervention; a destruction station, towards which the feed is advanced by the auto-adjusting feeding mechanism. Preferred examples of inventive automatic destruction machines include, e.g., automatic destruction machines wherein the feeding mechanism and the destruction station accommodate a load of non-uniform items; automatic destruction machines wherein the destruction station comprises a zero-clearance cutting system; automatic destruction machines wherein the machine accomplishes high-security destruction; etc.

In another preferred embodiment, the invention provides a method of feeding at least two types of non-uniform items during a same operational run, comprising, in normal operation of a motorized system in which the method is practiced: placing items in contact with a single moving feed path which moves the items, wherein movement of the single moving feed path is non-manually controlled during operation. The inventive feeding methods may comprise at least one of: (i) non-manual measurement of the inserted items and non-manual application of the measurement to control speed and/or direction of movement of the single moving feed path; (ii) non-manual measurement of current being drawn by at least one motor in the machine. The inventive feeding methods may include performing a non-manual measurement of current being drawn by at least one motor in the machine (and further may include non-manual comparison of the current measurement against a baseline current value). In the inventive feeding methods, the motor may drive one or more of a cutting mechanism; a shredding mechanism; a food processing mechanism; a disintegrating system; a comminuting system; a recycling mechanism; other shape-altering mechanism; etc.

Inventive auto-adjusting feeding systems may comprise a load entry point at which the load enters the system, and further comprising an action point at which the load begins to be acted upon by the processing mechanism (such as a system wherein sharp moving parts engage the load at the action point). Inventive auto-adjusting feeding systems may include continuous feeding without manual intervention of a load of items having at least a first thickness range and a second thickness range. Inventive auto-adjusting feeding systems may include at least one non-manual measurement that is directly or indirectly proportional to the load.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF PREFERRED EMBODIMENTS OF THE INVENTION

Figure 1:
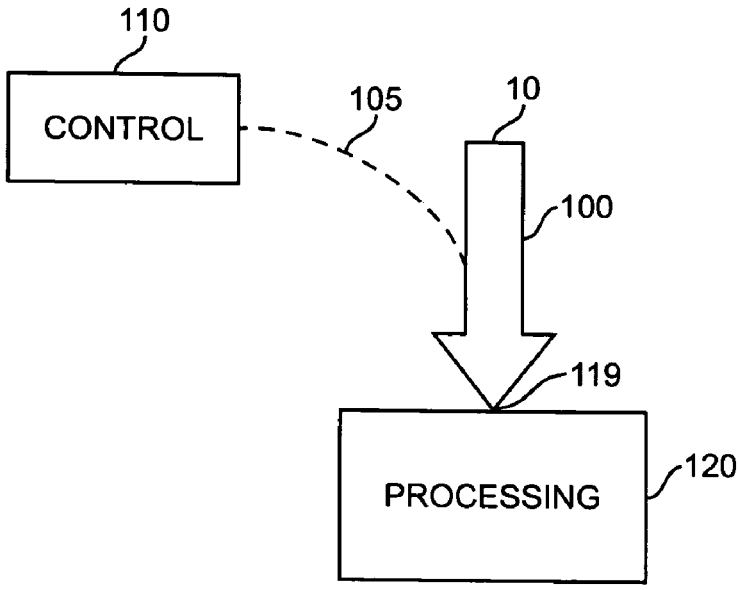
FIGS. 1 and 1A are block diagrams of inventive methods of self-adjusting feeding.

Referring to FIG. 1, the invention may be better appreciated. According to FIG. 1, a method may be practiced of feeding at least two types of non-uniform items (i.e., a load) during a same operational run in normal operation of a system (preferably a motorized system) in which the method is practiced.

Figure 1A:
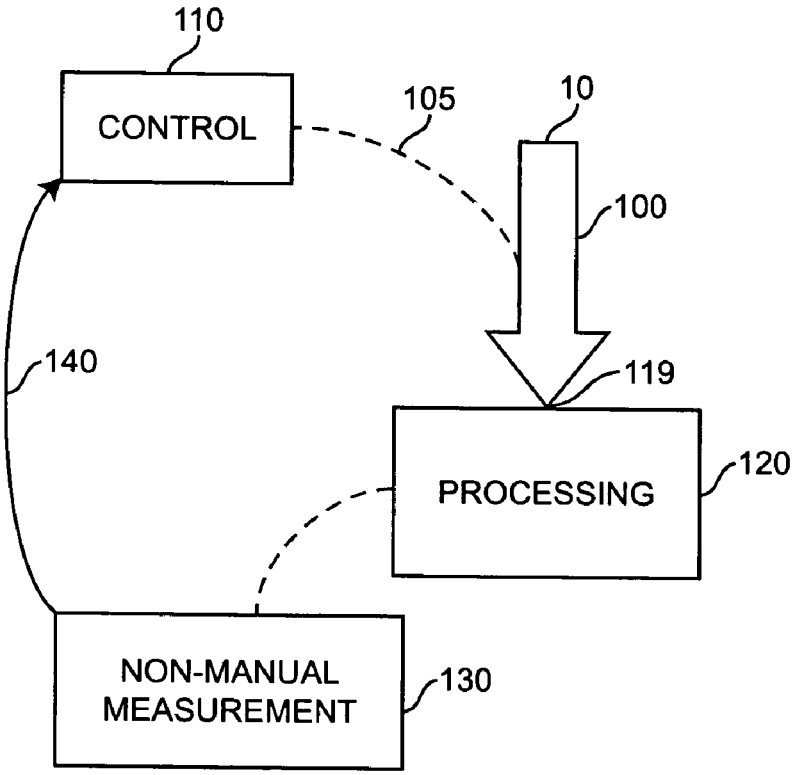

A single moving feed path 100 moves the items (i.e., the load of items), wherein movement of the single moving feed path 100 is non-manually controlled 110 during operation. The single moving feed path 100 moves towards a processing 120 step which preferably is performed by a motorized processing station. Examples of feed path 100 are, e.g., a conveyor belt mechanism; etc. In FIGS. 1, 1A, the feed path 100 is shown as an arrow pointing in the direction of ultimate desired destination at processing 120. However, the feed path 100 is not precluded from stopping and/or reversing direction, and preferably direction of feed path 100 is controllably reversible away from processing 120.

Referring to FIGS. 1 and 1A, at a load entry point 10 the load enters the system that comprises a self-adjusting feeding system and first begins to move on, in or along the single moving feed path 100. Examples of a load entry point 10 are, e.g., an input port or other hole or opening; a point on a conveyor belt on which a load is moved automatically without operator further intervention; etc.

At action point 119 the load begins to be acted upon by the processing mechanism 120 (such as a system wherein sharp moving parts engage the load at the action point 119).

FIG. 1A is a system according to FIG. 1 in which a non-manual measurement 130 is taken for characterizing the processing 120. While the non-manual measurement 130 is being taken, the single moving feed path 100 may still be moving the load and the processing 120 may still be proceeding. The measurement 130 is then non-manually processed and fed 140 for use in non-manually controlling 110 the single moving feed path 100, such as controlling the direction of movement of the feed path, the rate of speed of movement of the feed path, etc. Control 110 may comprise, e.g., one or more of: receiving non-manual data representing a measurement of feed path 100; receiving non-manual data representing a measurement of thickness of a load entering feed path 100; receiving non-manual data representing a measurement of processing 120; receiving non-manual data representing a measurement of vacuum performance; automated processing of received data; issuance of control commands for controlling feed path 100; etc.

In FIGS. 1 and 1A, control 110 and feed path 100 are shown connected by a single dashed line 105, for purposes of illustration. However, neither the number of measurements taken with respect to feed path 100 nor the number of control actions exercised on feed path 100 are limited, and there may be multiple measurements and/or control actions. Communication 105 between control 110 and feed path 100 comprises at least one of: non-manual communication of a measurement of feed path 100 to control 110; non-manual control of rate of speed of feed path 100; non-manual control of direction of travel of feed path 100. It further should be appreciated that the place at which the dotted communication line 105 in FIGS. 1, 1A meets the feed path 100 is not intended to be limiting and is for illustrative purposes, i.e., measurements and/or control can occur at any point(s) along feed path 100.

In the inventive systems, methods (such as the method according to FIG. 1), machines, apparatuses, etc. in which a load has been mentioned, non-limiting examples of the load are as follows. The load may be non-uniform as to at least one of: height dimension, width dimension, thickness, density and material composition, preferably with the load being non-uniform as to at least two, three, four or all of: height dimension, width dimension, thickness, density and material composition. The load may be of non-uniform material of at least two selected from the group consisting of loose paper, CDs, cryptographic key tape, DVDs, credit cards, SMART cards, cassette tapes, videotapes, other encased tape, free tape, books, boards, photographs; film; plastics; synthetic fibers; and other items. The load may comprise at least two of flat paper, crumpled paper, irregularly-shaped paper, torn paper, stapled paper and paper-clipped paper. Non-limiting examples of the load are, e.g., a non-uniform load of to-be-recycled items; a non-uniform load of to-be-destroyed items; etc.

In embodiments of the inventive systems, methods, apparatuses, etc., processing 120 may comprise a processing station has been mentioned. Preferably the processing station is motor-driven. When a motor-driven processing station is used, the motor speed may be non-manually controlled relative to the fed load and/or non-manual monitoring may be carried out of whether the processing station motor is drawing additional current above a set baseline current amount (such as, e.g., auto-adjusting feeding systems wherein upon a measurement being made in which the motor exceeds the baseline current amount, a non-manual control response (such as, e.g., a non-manual control response that comprises a non-manual adjustment of feeding rate of the load) is performed). Non-limiting examples of a processing station are, e.g., a processing station comprising a zero-clearance cutting system; a processing station that destroys the fed load to high-security destruction specifications; a processing station that destroys the fed load into information-unrecoverable form; a processing station that comprises at least one shape-changing mechanism (such as, e.g., a shredding mechanism; a cutting mechanism; a disintegrating system; a comminuting system; a food processing mechanism; a recycling mechanism; etc.) that operates mechanically and/or physically on items of the fed load. Preferred examples of a processing station are, e.g., a destruction station; a processing station that comprises a rotating cutter; etc. Additionally, inventive feed systems may suitably be provided and adapted for use in postal processing, package processing, etc.

Figure 2:
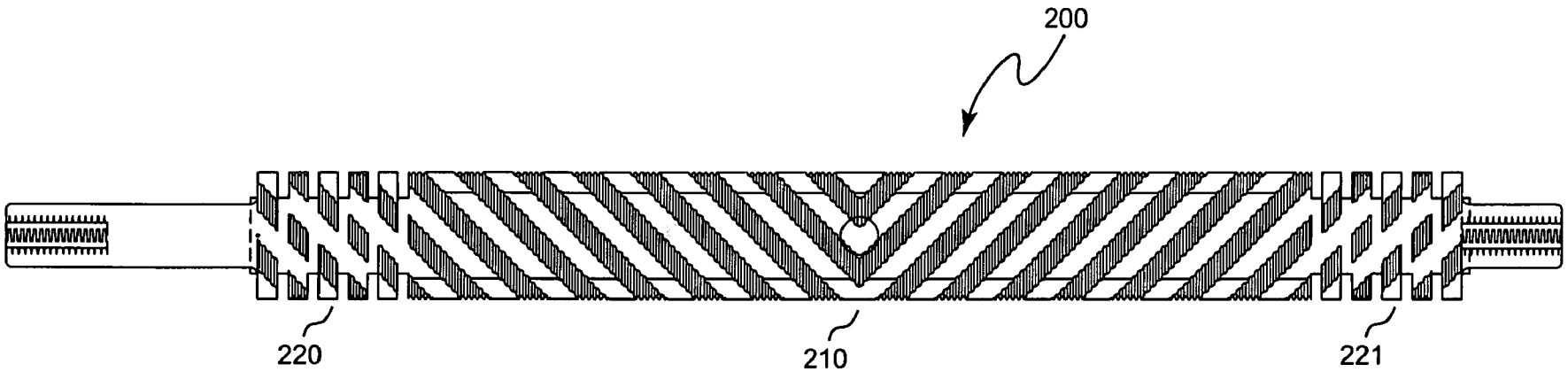
FIG. 2 is a perspective view of a double secondary shredder.

When processing 120 comprises a processing station for accomplishing high-security destruction, preferably the processing station comprises a double secondary shredder rotating cutter such as rotating cutter 200 in FIG. 2. Rotating cutter 200 in FIG. 2 is one non-limiting example of a preferred component for processing 120 and the present inventive self-adjusting feeding systems are not limited to use with rotating cutter 200, and many other processing 120 uses are within the present invention. In FIG. 2, rotating cutter 200 comprises a central primary cutter 210 which rotates around an axis. The secondary shredders 220, 221 rotate about an axis that is aligned with the axis about which the primary cutter 210 rotates, and preferably is the same axis. Such a rotating cutter 200 preferably is used with a relatively-softer sacrificial material (not shown) in a zero-clearance configuration (not shown).

Each of the inventive methods of FIGS. 1, 1A may be used for a mixture of different-dimensioned materials (such as a mixture of two or more of paper, free tape, encased tape (such as cassettes, videotapes, etc.), books, plastic cards, SMART cards, boards, etc.) to be fed, continuously, as a load, such as a load to a cutting mechanism (such as, e.g., zero-clearance cutting), shredding mechanism, etc. Continuous feeding is made possible by at least one non-manual measurement that is directly or indirectly proportional to the load. The rate at which the load is fed towards the cutter, shredder or other processing mechanism may be adjusted to be slower or faster based on a measurement of the characteristics of the load (such as one or more dimensions of the load, weight of the load, etc.).

According to the inventive methods of FIGS. 1, 1A, non-manual, load-self-evaluative feeding systems may be provided for feeding a load towards a motor-driven cutter. When a motor-driven cutter is processing 120 a load, the motor-driven cutter is slowed by the load (and corresponding cutter-motor current increase), with the amount of slowing related to the load. (It will be appreciated that a short time-lag exists between cutter loading and current increase.) The cutter's motor reacts to being slowed by the load by drawing more current. A measurement of the additional current drawn may be made. Such a measurement may be made automatically, and preferably is made automatically. The measurement of current drawn may be used to automatically adjust the feeding rate of the load.

The inventive methods of FIGS. 1, 1A may be used for sending a non-homogeneous load (such as a non-homogeneous load of to-be-destroyed material, a non-homogeneous load of to-be-sorted material, etc.) into a motorized cutting system (such as, e.g., a motorized zero-clearance cutting system, etc.). Non-limiting examples of a non-homogeneous load include, e.g., a load consisting of two or more of flat paper, crumpled paper, irregularly-shaped paper, torn paper, stapled paper, etc.; keytape; cassette tape (in cassette or not in cassette); videotape (in housing or not in housing); SMART card; credit card; plastic board; plywood; wooden plank; book; compact disk (CD); DVD; computer disk drive; etc. One example of a non-homogeneous load is some flat paper plus some crumpled paper. Another example of a non-homogeneous load is flat paper plus cassette tape. Another example of a non-homogeneous load is flat paper plus a CD or DVD. Another example of a non-homogeneous load is cassette tape in cassette plus loose cassette tape. In a most preferred embodiment, the present invention is used for feeding a non-homogeneous load into a high-security declassification system that completely destroys the load into high-security (dust-like) particles from which information that has been printed, burned, recorded or otherwise imparted on the load is converted into information-unrecoverable form.

For a non-homogeneous load being advanced through a feed system (such as feed system 100 in FIG. 1 or 1A) into contact with a processing 120 station which is a cutter (e.g., a cutter for high-security destruction, such as high-security destruction into an information-unrecoverable powder or dust), cutter-motor current may be measured (as an example of non-manual measurement 130 in FIG. 1A), and the cutter-motor current measurement may be fed back to control 110 (which control may even include reversing) the feed system 100.

The present invention may be used, most preferably, in destruction technology, and also may be used in other technologies such as food preparation shredding; non-destructive shredding in manufacturing (such as plastic being "shredded" or reduced to pellets prior to injection molding, etc.); etc.

When constructing a destruction machine according to the present invention, preferred features to include are, e.g., non-manual load-sensing to adjust machine behavior to the type and size of load, and process that load in the shortest possible time, consistent with machine's basic horsepower; automatic overload-reversal to back out of overloads, and then automatically switch back into forward feed, to keep destroying the load when load sensors determine that doing so is appropriate (a mechanical version of a boa constrictor ingesting a large animal); an operator-triggered automatic jam-clearing routine; an operator-triggered automatic feed-reversal routine for safety and operator mistake recovery; an automatic self-clearing routine, self-triggered when heavy loads have passed through; jam-resistance based on internal automation such as automated overload-handling routines; backup manual jam-clearing (such as providing a hole through which an operator may insert a wrench and turn the wrench); etc.

Figure 3A:
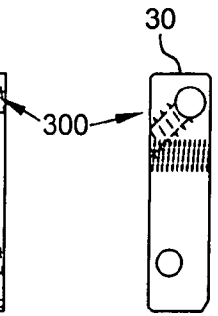
FIG. 3A is a side view corresponding to FIG. 3.
Figure 3:
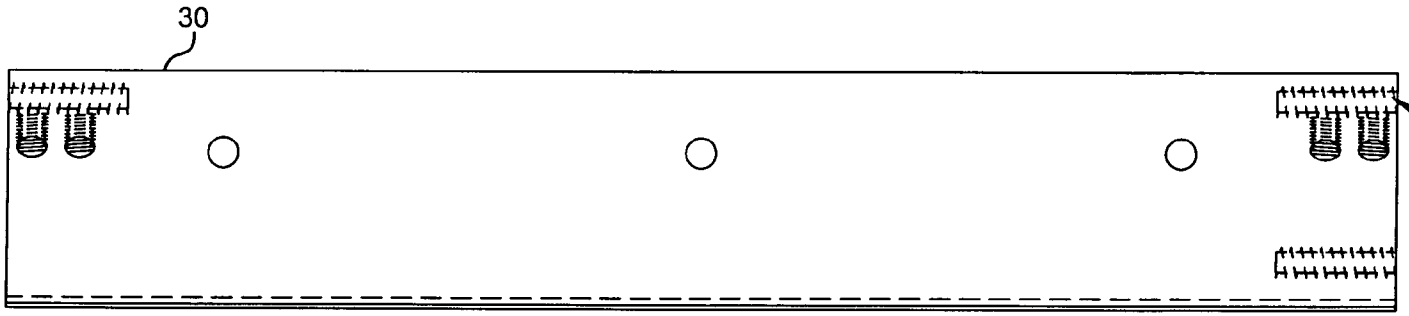
FIG. 3 is a front view of a front material guide 30 for use in the invention.

Referring to FIGS. 3-9B, parts and assemblies are shown for practicing the invention, such as, e.g., guiding material in a self-adjusting non-manual feeding system. FIG. 3 depicts front material guide 30. Front material guide 30 may be used to provide either a fixed guide system or a swinging or pivoting guide that measures thickness of fed material (such as to-be-destroyed material). In such a case of a swinging guide system, pivot is about guide pivot center 300. However, it is not necessary for the guide 30 to swing or pivot, and guide 30 may be a fixed guide. For example, when guide 30 is fixed, a load of same thickness may be accommodated by controlling basic feed rate (such as, e.g., of feed path 100 in FIGS. 1, 1A).

Figure 4A:
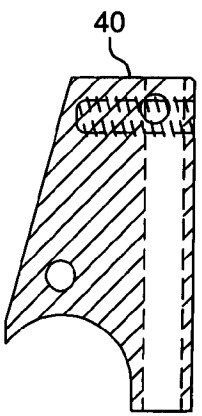
FIG. 4A is a side view corresponding to FIG. 4.
Figure 4:
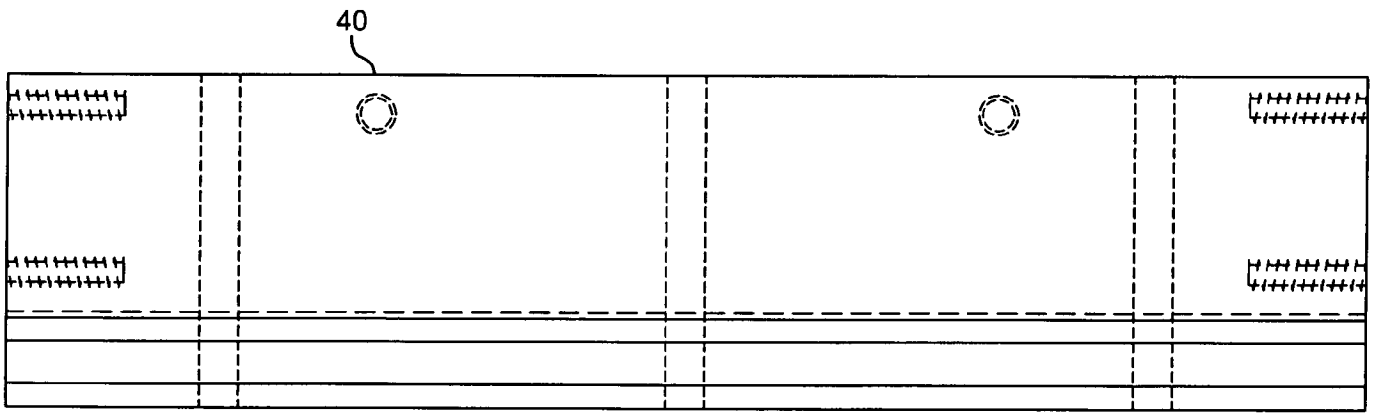
FIG. 4 is a front view of a rear material guide 40 for use with the front material guide 30 of FIG. 3.

Front material guide 30 (FIGS. 3, 3A) is used with rear material guide 40 depicted in FIGS. 4, 4A. Rear material guide 40 may be made of one piece, such as a single piece of aluminum (such as a single piece of aluminum sized 1.2×2.1×8.72 inches for constructing a machine which is to be used for shredding paper). Rear material guide 40 will be installed in the guide assembly in a fixed-position.

Figure 5B:
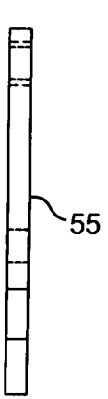
FIG. 5B is a side view of the right-hand side guide plate 55 of FIG. 5A.
Figure 5A:
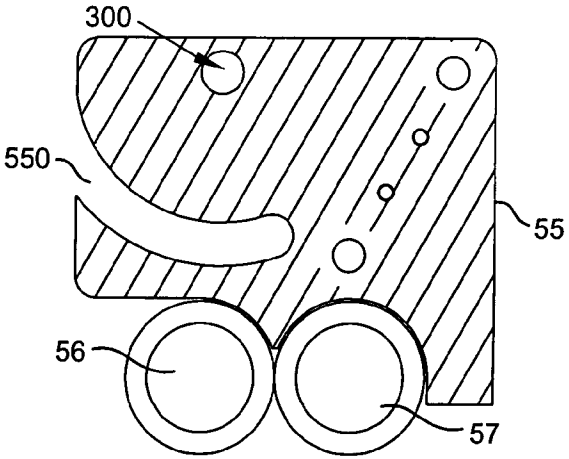
FIG. 5A is a top view of a right-hand side guide plate 55.
Figure 5:
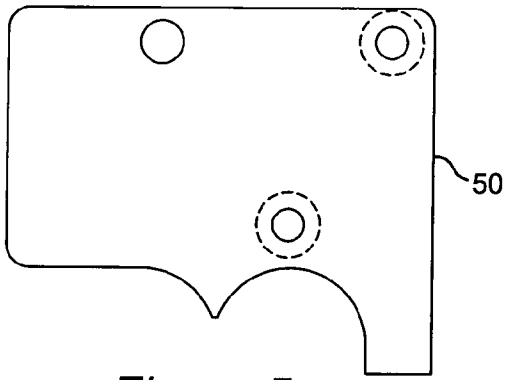
FIG. 5 is top view of a left-hand side guide plate 50.

A left-hand side guide plate 50 (FIG. 5) and a right-hand side guide plate 55 (FIG. 5A) together may be used with front material guide 30 and rear material guide 40. Right-hand side guide plate 55 (FIG. 5A) includes guide pivot center 300 corresponding to guide pivot center 300 in the front material guide 30 (FIGS. 3, 3A). Right-hand side guide plate 55 (FIG. 5A) includes radial slot 550. Right-hand side guide plate 55 is used in connection with variable-position pinch roller 56 and fixed-position pinch roller 57.

Figure 7:
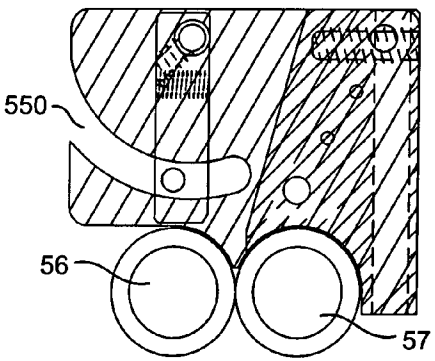
FIG. 7 is a top view showing the right-hand side guide plate 55 of FIG. 5A with the front material guide 30 (FIG. 3) and the rear material guide 40 (FIG. 4) mounted.

The front material guide 30 and the rear material guide 40 are mounted on the right-hand side guide plate 55 as shown in FIG. 7.

To sense position of the front material guide 30, a switch (such as miniature switch 60 in FIG. 6) may be used. Miniature switch 60 is a snap-action switch which senses position of the front material guide 30.

Figure 6B:
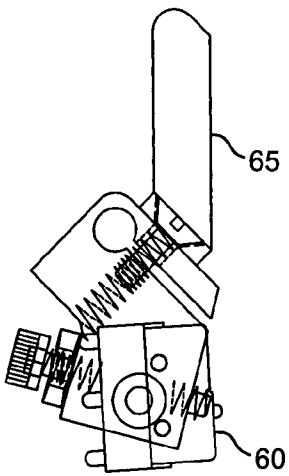
FIG. 6B is a top view showing the switch of FIG. 6 mounted on the arm of FIG. 6A.
Figure 6A:
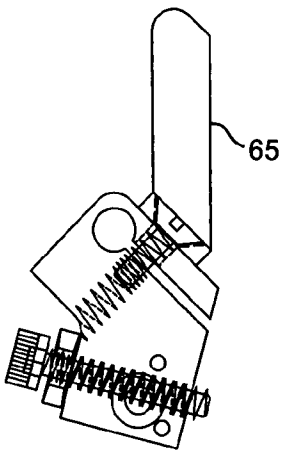
FIG. 6A is a top view of an arm for use in the invention.
Figure 6:
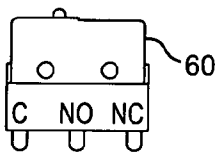
FIG. 6 depicts a switch for use in the invention.
Figure 8:
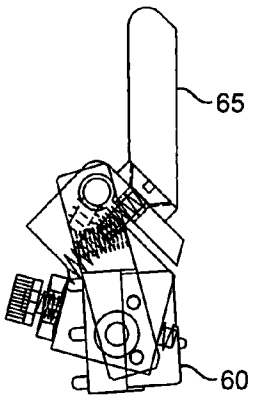
FIG. 8 is a side view of the arm of FIG. 6A with the guide of FIGS. 3 & 4 and the switch of FIG. 6 mounted.
Figure 8A:
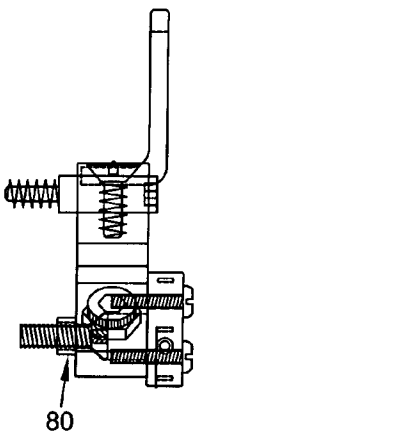
FIG. 8A is a front view corresponding to FIG. 8.

An arm 65 (FIG. 6A) is provided, with the arm being suitable to hold the position sensing switch 60 (FIG. 6). The switch 60 is mounted on the arm 65 as shown in FIG. 6B. The guide is mounted on the arm 65 as shown in FIGS. 8, 8A. A spacer 80 (FIG. 8A) is provided. The spacer 80 has a sliding fit to the radial slot 550 in the right side plate 55.

Figure 9A:
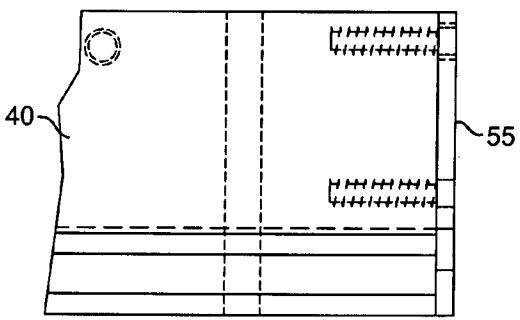
FIG. 9A shows the rear guide 40 assembled with the right side plate 55.
Figure 9B:
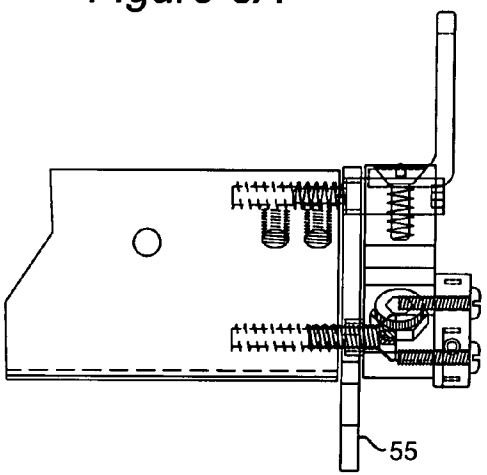
FIG. 9B shows the front guide 30 assembled with the right side plate 55.
Figure 9:
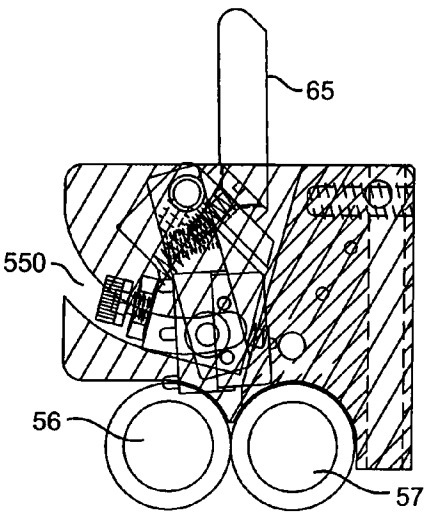
FIG. 9 includes front and side views of an assembly of the parts of FIGS. 3-8A.

The front material guide 30, rear material guide 40, left-hand side guide plate 50, right-hand side guide plate 55, switch 60, arm 65, radial slot 550, pinch rollers 56, 57 and spacer 80 are assembled as shown in FIG. 9. The rear guide 40 is assembled with the right side plate 55 as shown in FIG. 9A. The front guide 30 is assembled with the right side plate 55 as shown in FIG. 9B. In FIG. 9B, the separation between parts is exaggerated. The front guide 30 and the arm 65, in an embodiment of a swinging guide system, swing as one part. However, swinging is not required and the guide system may be fixed, as mentioned above.

The invention may be further appreciated with reference to the following Examples, understanding that those Examples are not intended to limit the invention.

EXAMPLE 1

Referring to FIG. 1A, when the processing 120 comprises a motor-driven cutter (such as a rotating cutter), when the load (which may be a mixed load) is being fed towards the motor-driven cutter (such as a rotating cutter), the non-manual measurement 130 may be a measurement of current drawn by the cutter motor. In such a case, the current measurement is directly proportional to load.

EXAMPLE 2

When the processing 120 comprises a cutter, non-manual measurement 130 may comprise a crude, non-manual measurement of the load made before the load encounters the cutter. The feeding rate of the load (traveling on or in feed system 100) may be controlled 110 (such as slowed or increased) before the load encounters the cutter in processing 120. The system of this Example 2 may be used alone or in combination with a system of Example 1.

Referring to FIGS. 1, 1A, in a preferred embodiment, controlling 110 comprises a measurement (preferably a non-manual measurement) being made of the actual thickness of the load fed-in to feed system 100, and the feed is pre-slowed, as needed, in anticipation of the load's arrival 119 at the cutter.

EXAMPLE 2A

Pre-slowing as mentioned in Example 2 has been accomplished in one example by providing a spring-loaded, swinging vane that is pushed by load thickness. The vane actuates a switch, connected to the feed speed-control circuit that controls the feed path (such as feed path 100 in FIG. 1 or 1A).

EXAMPLE 3

In addition to manipulation of feeding rate for feed path 100 in FIGS. 1, 1A in a forward direction, there also may be used a step of reversing direction of the load traveling on feed path 100. For example, feed drive motor current associated with feed path 100 may be measured, and when the load is so thick that it overloads the feed mechanism, direction of feed path 100 is reversed to travel away from processing 120.

EXAMPLE 4

Figure 1B:
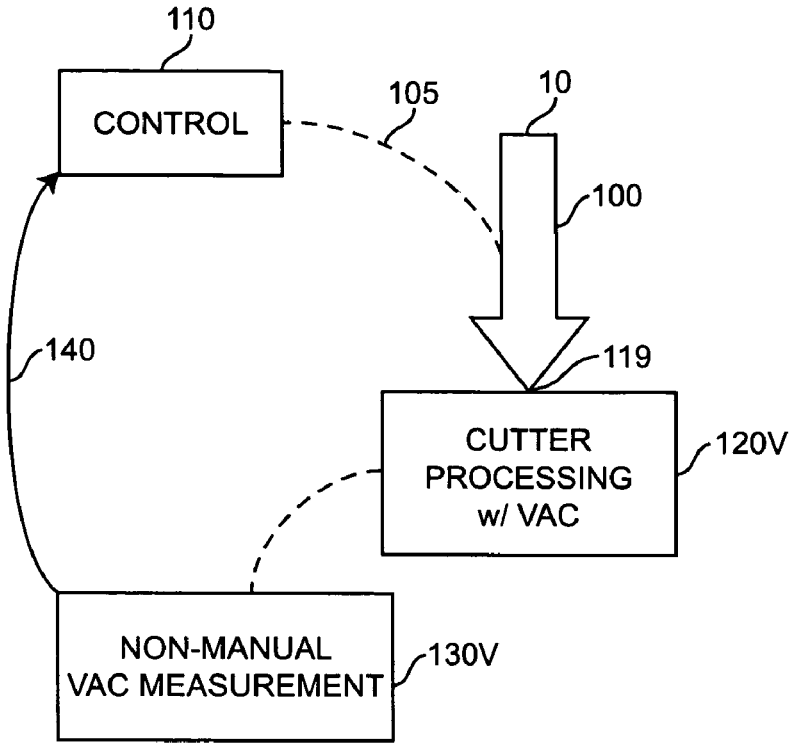
FIG. 1B is a block diagram corresponding to FIG. 1A for an example in which processing 120 comprises at least one cutter and vacuuming.

Systems such as in FIGS. 1, 1A may comprise processing 200 in which a cutter (such as double secondary shredder cutter 200 in FIG. 2) is included, such as the cutter processing system of FIG. 1B. In a system comprising cutter processing, preferably the system comprises vacuuming output from the cutter. FIG. 1B shows processing 120V which is cutter processing with vacuuming. In such a system comprising cutter processing with vacuuming of the output from the cutter (120'), when the output from the cutter is being vacuumed, feed path 100 may be controlled 110, 105 to be stopped or reversed based on a non-manual vacuum-related measurement 130V which is a measure of vacuum performance (such as when vacuum suction falls below a limit set as acceptable). Vacuum-correlated feed adjustment 130V may be used alone or in combination with one or more other feed adjustments (such as a heat-correlated feed adjustment, a load thickness-correlated feed adjustment, etc.).

EXAMPLE 5

Figure 1C:
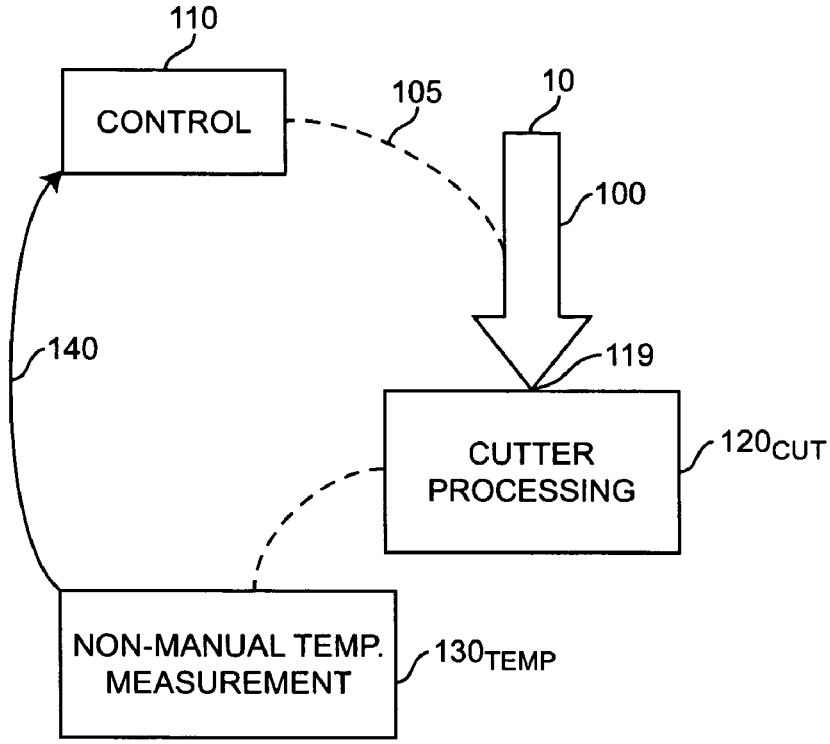
FIG. 1C is a block diagram corresponding to FIG. 1A for an example in which processing 120 comprising at least one cutter.

Temperature may be sensed to anticipate a possible jam or overload. For example, in a cutting system such as FIG. 1C including cutter processing $\mathbf{120}_{CUT}$ (such as, e.g., a cutter comprising a primary rotating cutter having an axis and at least one secondary cutter sharing the axis), temperature may be sensed in the vicinity of a cutter (such as in a vicinity of a primary or secondary cutter) and a non-manual temperature measurement $\mathbf{130}_{TEMP}$ may be communicated 140 to control 110 for processing and controlling 110, 105 the feed path 100.

EXAMPLE 6

An example of an inventive destruction machine comprising load self-adjusting feeding is as follows. The destruction machine of this Example cycles an 8½×11 paper sheet in about 5 seconds or less, depending on height of the stack (with a minimum stack preferably being at least 3 sheets). Typically the destruction machine of this example can receive and destroy a fed stack of 4-5 sheets in 5 seconds or less.

The destruction machine of this example is approximately 20 inches wide by 12 inches deep by 13 inches tall. The actual "head" size is much smaller, about 16 inches by 10 inches by 12 inches. The remaining volume of the destruction machine that is not the "head" is mainly for residue collection and cabinetry. The weight of the entire machine is under about 70 lbs, complete, with the head weighing about 50 lbs.

For this cutter-based destruction machine, residue collection is accomplished with an on-board vacuum system that discharges into a disposable bag or enclosed residue chamber.

In this Example, to-be-destroyed material is feed into the machine from the top.

The machine's power requirement is 120 VAC, 60 Hz, 20 Amp service for max performance. The machine uses about 9-10 amps, typically, and uses 17 Amps at typical peak power and 9-10 amps at light loads.

The machine of this Example has at least the capability to destroy: paper documents (8.75" entry throat width); photographic film, including "spy film"; photographic negatives; photographic prints; cryptographic key tape; magnetic recording tape (digital, audio, analog, video, DLT, etc.); compact disks; DVDs; SMART cards; credit cards; ID badges; etc. Upon removal or non-inclusion of any metallic hub in the machine, the machine further has the capability to destroy floppy disks. Metal objects can also be processed by the machine of this inventive Example 6, but with correspondingly higher wear to machine cutting elements.

For the destruction machine of this Example, residue handling and disposal may be as follows. The residue is mostly dust-like particles. Typically, over 90% by weight passes through a 1 mm screen (meaning a screen whose rectangular openings are 1 mm×1 mm). It should be remembered, when inputting CDs and DVDs into the machine, that the dyes used in some recordable CDs and DVDs may be toxic. For the machine operator to avoid touching CD and/or DVD residue, disposable bags may be used to collect residue. In this example, an on-board vacuum system discharges to a residue collection nozzle, which can then discharge into a variety of containment devices: a) directly into a disposable, self-closing filter bag (which may be disposed of); b) into an on-board (or separate) residue chamber, with air exhaust through a disposable filter bag, good for many empty-refill cycles; c) into a local "shop-vac" (common, inexpensive type), or a central vacuum system; d) into a plastic bag supported by a wire-frame holder (optionally collapsible, for tight spaces), topped by a special lid; etc. A composition example is as follows: d1) A waste-basket-shaped wire frame, lined with a plastic bag; d2) The open end of the bag is draped over the edge of the waste-basket; d3) The basket-with-bag is topped by the lid, with quick-release clamps, to seal the bag between the basket rim and the lid; d4) The lid has an inlet port for the discharge hose from the machine, and a wide-mouth bag collar; d5) The bag collar holds a vertical filter bag, secured with an elastic band; d6) The residue tends to fall into the plastic bag, and clean air is exhausted by the filter bag; d7) Air-borne particles going up into the bag will tend to fall back down through the wide-mouth collar. In an emergency, residue can be permitted to discharge directly into the work area if no bag or filter device is available. A 15-gallon residue chamber was fabricated, topped by filter bags. A commercially available plastic "re-closable" drum was used, with the drum lid modified as follows: a) an inlet port was added to accept a standard 1.25" vacuum nozzle; b) 3 wide-mouth ports were added (about 4" diameter). Standard filter bags were attached over these cylindrical ports with rubber bands. In the experiment performed, the three filter bags let filtered exhaust air escape, and residue simply fell into the drum (which was lined with commercially available trash bags.)

A silent vacuum unit (invented by the present inventor) optionally may be used to reduce the acoustic noise contribution, which would normally emanate from a conventional workshop vacuum cleaner.

Main Cutter Device

In this Example, the cutter is made out of a cobalt-steel alloy, and hard-coated with a Swiss-developed "Futura" coating (Balzers, Inc., headquartered at Iramali 18 FL-9496 Principality of Liechtenstein ). This material has been found to increase cutter life about four-fold over a Titanium-Nitride coated high speed steel cutter in this type of application.

Main Cutter Motor Drive

A synchronous-belt (such as "L"-class) drive, achieving a huge acoustic noise reduction, is used. Belt width can be widened for more longevity or horsepower. Belts are cheap and easy to replace. An L-class drive belt system withstands repeated hard-stop jams to full-current stalls, with no current-limiting (when deliberately induced).

Controls

In this Example, the controls comprise A) load management, B) jam-clearing management, and C) safety and protective controls.

The load management element of the controls is as follows. An adaptive system is provided, which changes inlet material feed rate according to load. The machine is set to move as fast as it possibly can, according to actual load. A required minimum rate is a 3-page stack in 5 seconds in this Example, which is 11" in 5 seconds, linear feed rate (11 ft/min). Typically a 5-page stack is destroyed by the machine of this Example in 5 seconds. Bound paper material that is ⅛" or ¼" thick (such as a manual or a magazine) can be processed without any operator intervention; the machine just goes slower (i.e., a slower ft/min linear rate).

The machine of this Example automatically adapts to: regular paper documents, photos, etc.; key tape, in side-by-side multiple strips, or a stack of strips, or side-by-side stacks of multiple strips; CDs and DVDs; credit cards, "Smart" cards, ID badges, etc. When CDs or DVDs are feed, the feed runs slower than when, for example, regular paper documents are fed, but does destroy a CD or DVD in 5 seconds maximum.

The jam-clearing management of the machine of this Example is as follows. The machine clears itself automatically, or by operator command. The machine also has two "back-up" schemes for manual jam clearing without any disassembly. In case of a bad jam, the machine can be quickly opened to get right to the guts and manually clear the jam. The machine also can be made to clear a jam by just pressing a button; the button activates subcircuits which reach into the electronics already there, and impose a special, limited-power, phased control sequence.

The safety and protective controls included a "panic" button, that can be pressed if an operator's necktie, long hair, or the like gets pulled into the feed rollers. Protection for overcurrent, overheating, etc. also is included.

Automation

In the machine of this example, feedback devices (current measurements, motor tachometers, etc) are installed. High-power semiconductor control blocks are physically mounted and heat-sunk to the machine frame members. Rugged, industrial-grade, phase-angle fired, integrated AC control blocks are used.

A way to sense how thick the input material is, so as to permit automatic machine compensation for load without operator intervention, was included. A guide system measures thickness of the load and sends a signal to the feed system to anticipate the load before the load gets to the cutting mechanism. Thus the machine self-evaluates and cannot bite off more than its cutting mechanism can safely chew.

It was desirable to avoid requiring a selector knob on the front panel to control behavior according to material to be destroyed. Thus this machine was made to be operated completely automatically, regardless of what load is inserted into the machine (paper, CDs, DVDs, key tape, spy film, photos, etc.). An example of a stack thickness that the machine of this Example comfortably destroys is ⅛" thick, and thicker.

This machine includes fully automatic controls, as follows, for the following modes of operation:

1—Normal load running in the fastest operation. 3-5 pages in 5 seconds max.

2—Larger load running with feed rate reduced (with an accompanying "HEAVY LOAD-SLOWING FEED" indicator lamp) until system adjusts, then feed rate increases.

3—Thick load programming (No indicator): In this mode of operation, a forced feed rate reduction occurs, triggered by sensing of something thicker than about 5 sheets of paper—like a CD or DVD. A CD or DVD is done in under 5 seconds.

4—Depending on the load, an indicator lamp for "HEAVY LOAD-SLOWING FEED" may also light up, announcing even further speed reduction. When the load eases, feed rate resumes, with a controlled acceleration.

5—Moderate overload. An indicator lamp for "VERY HEAVY LOAD-REVERSING FEED" lights. The feed reverses to prevent a jam or overload. When the load eases, forward feed resumes, with a controlled acceleration. The indicator light goes out.

6—Severe overload. An indicator lamp for "OVERLOAD SHUTDOWN" lights. The cutter system shuts down, and latches off. The feed reverses to help clear the cutter area. The operator can reset simply by cycling power off and then on, without the operator needing to intervene into the machine and/or disassemble the machine.

7—Cutter Overheat. A "CUTTER OVERHEAT" indicator lamp lights. Fully automatic functions accompany cutter overheat mode. Actions include: a) an indicator light for "VERY HEAVY LOAD-REVERSING FEED" comes on; b) the system reverses feed until the problem goes away. To avoid the possibility that otherwise could be caused (by overloading) of the last part of a cutting system heating up and resulting in a jam, if feeding were left unrestricted (a system which usually simply corrects itself in the inventive machine of this Example), the inventor included a further measure. Namely, the heat buildup is the clue that the inventor exploits to prevent the undesirable result of such a jam. A function is triggered by a precision temperature measurement and control circuit, which monitors the last section of the destruction system. When triggered due to a temperature measurement exceeding a certain set level, a sub-circuit reverses the feed rollers. Thus, any current or subsequent feed overload is removed until the problem causing the high temperature is cleared. The main cutter and vacuum system remain on (this is essential) to help clear the problem. When the temperature drops about 3 degrees C. below the trigger setpoint, normal operation resumes. Such a heat build-up is difficult to induce and does not ordinarily occur in normal operation. When such a condition is deliberately induced, the machine automatically clears the problem in about 20 seconds, without operator intervention.

8—Vacuum Loss. A "WEAK VAC" indicator lamp lights. A fully automatic function is provided. Actions include: a) "VERY HEAVY LOAD-REVERSING FEED" indicator lamp comes on; b) System reverses feed until the problem goes away. The background for this function is as follows. Adequate vacuum is essential to normal operation. Vacuum transports the residue from the destruction area. If vacuum fails or becomes too weak, the machine might choke on its own residue, and eventually automatically go into reverse-feed due to overheating at the last section of the destruction system. Examples of causes of vacuum loss would be, e.g., a full residue container, a temporary blockage of the residue path, a clogged air exhaust filter, or simple partial or total failure of the on-board or external vacuum collection system. The inventive machine senses inadequate vacuum and automatically takes appropriate control action. For example, the machine includes a simple diaphragm-operated switch, set to the appropriate vacuum set point, or a low-cost amplified silicon pressure sensor integrated circuit module. A vacuum loss measurement triggers a sub-circuit to reverse the feed rollers, which results in removal from the destruction area of any current or subsequent destruction feed until the problem is cleared. The main cutter and vacuum system remain on (this is essential) to help clear the problem. When the vacuum suction is restored to a level above the setpoint, normal operation resumes. When such a condition is deliberately induced in the machine of this Example as an experiment, the automatic controls work reliably and quickly.

The inventive machine of this example has relatively few operator controls as follows: a power switch (which is also the main power circuit-breaker—a "breaker-type" switch); a push-button for manually reversing feed; an emergency shutdown button; and an auto jam clear button.

The manual reverse button may be used in any situation where the operator sees a need. "VERY HEAVY LOAD-REVERSING FEED" indicator lights up, and the feed is reversed, with a controlled acceleration. The cutter keeps operating. When the operator releases the manual reverse button, forward feed resumes, with a controlled acceleration. This manual reverse button is useful to have in case, e.g., a necktie, clothing or hair gets caught in the feed; the operator changes his/her mind about destroying the input items and wants to try to save what's left; to assist in destruction of an unusual item.

The "EMERGENCY SHUTDOWN" button provided is a momentary push-button. Effect: The "OVERLOAD SHUTDOWN" lamp lights up and the "VERY HEAVY LOAD-REVERSING FEED" lamp lights up. The feed reverses, with a controlled acceleration, and keeps running (latched) in reverse. The cutter shuts down and latches off. An emergency shutdown button is useful to have in case: a necktie, clothing or hair gets caught in the feed; the operator changes his/her mind—and wants to save what's left; any malfunction or for any reason the operator does not like what's occurring.

The auto jam clear button is a momentary push-button. Effect: The "VERY HEAVY LOAD-REVERSING FEED" lamp lights up. Feed reverses, with a controlled acceleration, and keeps running (latched) in reverse. The cutter shuts down and re-starts in reverse to help clear a jam. Cutter runs a few seconds in reverse, then shuts down again. The "AUTO JAM CLEAR" indicator goes out when the sequence is complete. The "OVERLOAD SHUTDOWN" lamp lights up. The feed continues running in reverse. The operator now switches the main power off to re-set and re-start the machine.

The machine of this example is provided with the following operator indicators:

"HEAVY LOAD-SLOWING FEED" indicator lamp

"VERY HEAVY LOAD-REVERSING FEED" indicator lamp (may be integrated into the MANUAL FEED REVERSE button)

"MAIN SYSTEM SHUTDOWN" indicator lamp

"AUTO JAM CLEAR" indicator lamp—goes out when sequence is complete

"LOW VACUUM" indicator lamp—could be due to full bag, vacuum failure, etc.

"CUTTER OVERHEAT" indicator lamp—refers to mechanical overheat in cutter system

"FEED OVERHEAT" indicator lamp—refers to Feed Roller Motor

"REPLACE BLADE" indicator lamp—means that it's time to replace the blade

"MACHINE TOTAL HOURS" digital indicator (hours and tenths)

EXAMPLE 6A

Feed System Overload Detection

The inventive feed system overload detection of this Example 6A is used in the machine of Example 6, and also may be used in other machines. Pinch rollers are provided, like an old-fashioned wringer washing machine, to squeeze, hold, and control the to-be-destroyed material as it is advanced into the cutting area. Both rollers are driven by a special gear train, so as to always operate at exactly the same speed, which minimizes roller wear due to friction and abrasion. One roller's "axle" is fixed. The opposite roller's "axle" floats to allow thicker material to enter, while exerting considerable squeezing pressure for positive control of feed rate, and while also maintaining synchronism with the fixed roller. Because the rollers are rubber-coated, then can engage something too thick for the system to handle. This can cause the feed system to stall from overload.

Rather than depending on an operator being alert and engaging the manual feed reverse button, an automated solution is implemented as follows. Feed drive motor current is monitored, and when feed drive motor current exceeds a preset threshold, the feed system automatically reverses for a few seconds, and then tries again. The feed motor is thereby taken out of the stalled condition, and the overloaded-feed problem is cleared, usually without any operator intervention.

If the feed motor is repeatedly and severely overloaded, it will overheat and shut down the machine. The "FEED OVERHEAT" indicator and "MAIN SYSTEM SHUTDOWN" indicator will both light up.

EXAMPLE 6B

Automatic Routines to Help Keep Machine Clear and Clean

When a thick paper load passes though an inventive machine according to Example 6, sometimes some small scraps can remain in the feed roller area. In general, these scraps get sucked in and destroyed as normal machine operation continues. However, scraps might contain sensitive data, and the operator might be done, so there would be no such "continuing normal machine use". Therefore, a routine is optionally added which briefly reverses the roller feed if a large (thick) load has been processed for more than a few seconds. When the guides automatically sense that the large thickness has terminated, the feed rollers automatically briefly reverse, and other nearby structures brush off, scrape, and guide such scraps into the cutting area. The feed rollers then resume their normal forward feed rotation. This brief routine is entirely automatic. An additional benefit of the automatic routine of this Example 6B is to help keep the rubber-covered rollers clean.

The feature of this Example 6B was studied and considered to slow down the machine of Example 6 more than might be wanted. Therefore, the circuitry for this feature is optionally disabled. Instead, a simple routine that does this brief feed reversal at fixed intervals may optionally be used.

"Knife mill" may be the nearest, almost-fitting terminology for the inventive machine of Example 6 which has characteristics of both shredders and disintegrators, but with surprising additional characteristics which neither conventional machine has. The inventive machine of Example 6 lacks some disadvantageous components of conventional shredders and disintegrators, such as, e.g., lacking a conventional screen (which disintegrators always must have); needing no oil (which all high-security shredders besides those of the inventor require) and only needing occasional greasing of a few small gears; not needing to use water (which some disintegrators require); requiring no adjustment of blade clearances (which disintegrators require) but rather using a zero-clearance destruction system, which is continuously and automatically self-adjusting; needing no cutter wipers (which some shredders have, to keep stringy particles moving through the shredder heads); avoiding large numbers of delicate and intricate shredding parts, blades, shafts, cutters, etc. and only relying on a single basic rugged moving part; not requiring a microprocessor, menus, programs, etc. and therefore nothing to "re-boot", nor anything to "crash". Thus, the inventive high-security destruction machine of Example 6 advantageously avoids many shortcomings of other high-security destruction devices.

EXAMPLE 7

Increased Capacity

With added horsepower, using the same machine package as in Example 6, capacity can be about doubled. The throat width may be increased somewhat, such as to about 9½" (or to 12", so as to be able to take a standard page sideways). Double capacity is achieved at a machine basic "head" weight cost of only about 15 more lbs., depending on throat width. (The "extra" motor, to double the horsepower only weighs about 8 lbs). For a 12" throat, weight would go up about 15-20 lbs, because the cabinet gets bigger.

The electronics for the double-capacity machine are as follows: 220 volts, single phase. Power electronics to drive the motors in the double-capacity machine are as in Example 6. A second SCR "power block" package is added for reversing control of the second motor (because the second motor is in series, not parallel, with the first motor, so that isolated reversing switching is needed). This "series wiring" design strategy provides 220 volt operation, with the same 120-volt motors used in Example 6, but simply wired in series. This design strategy of Example 7 optimizes motor volume. The mechanical drive is constructed as follows. The motors are small enough that horsepower can be doubled by simply coupling the motor shafts, end-to-end. In this Example 7 vacuuming is constructed as follows. The air volume does not necessitate an extra vacuum unit. The two pickup points are manifolded to one vacuum inlet port. Residue collection capacity is adjusted for the increased volume, by providing suitable cabinet size.

The double-capacity cutter may be according to FIG. 2. One way is to make the cutter in one piece. Another way is to make the cutter in two pieces, joined at the midpoint. FIG. 2 shows a preferred example of a cutter which may be motorized and used in the present invention.

For guiding to-be-destroyed material in a destruction machine such as this Example 7, parts and systems according to FIGS. 3-9B may be used.

The above Examples 1-7 may be practiced singly and in various combinations, and may be adapted and modified within the scope of the present invention. An especially preferred use of the present invention is in a cutting system (such as, e.g., a zero-clearance cutting system, a cutting system for high-security declassification, a cutting system applied to a non-homogeneous load (such as a cutting system for destroying a non-homogeneous load into a high security information unrecoverable output (such as, e.g., a dust or powder, etc.)), etc.).

While the invention has been described in terms of preferred embodiments, those skilled in the art will recognize that the invention can be practiced with modification within the spirit and scope of the appended claims.

Having thus described my invention, what I claim as new and desire to secure by Letters Patent is as follows:

1. An auto-adjusting feeding system for feeding a non-uniform load towards a motor-driven processing station, wherein the load comprises a plurality of items wherein uniformity of the items is not required, comprising:

(a) an undivided moving feed path along which the non-uniform items travel together to the motor-driven processing station;

(b) an automatic measurement system wherein effect of the load on the processing station is measured without human operator intervention during feeding operation, including a non-manual monitoring system by which is monitored whether a motor driving the motor-driven processing station is drawing additional current above a set baseline current amount; and (c) an automatic adjustment system wherein during feeding operation feed of the load is adjusted without human operator intervention.

2. The auto-adjusting feeding system of claim 1, wherein the load is of non-uniform material of at least two selected from the group consisting of loose paper, cryptographic key tape, CDs, DVDs, credit cards, SMART cards, cassette tapes, videotapes, other encased tape, free tape, books, boards, photographs; film; plastics; synthetic fibers; and other items.

3. The auto-adjusting feeding system of claim 1, wherein the processing station is motor-driven and the motor speed is non-manually controlled relative to the fed load.

4. The auto-adjusting feeding system of claim 1, including a non-manual control response system wherein upon a measurement being made in which the motor exceeds the baseline current amount, a non-manual control response is performed.

5. The auto-adjusting feeding system of claim 4, wherein the non-manual control response comprises a non-manual adjustment of feeding rate of the load.

6. The auto-adjusting feeding system of claim 1, comprising an automatic measurement system and an automatic adjustment system that make a non-manual destruction-stage current measurement and that perform feedback of the current measurement to non-manually control load feed.

7. The auto-adjusting feeding system of claim 1, wherein the load comprises at least two of flat paper, crumpled paper, irregularly-shaped paper, torn paper, stapled paper and paper-clipped paper.

8. The system of claim 1, wherein the moving feed path is a conveyor belt mechanism.

9. The system of claim 1, wherein the automatic measurement system makes a measurement of vacuum performance.

10. The system of claim 1, including:

a front material guide;

a rear material guide;

left-hand side guide plate;

right-hand side guide plate;

a switch to sense position of the front material guide;

an arm;

a radial slot;

a first pinch roller and a second pinch roller;

and a spacer.

11. The system of claim 1, including an automatic measurement system that makes a crude, non-manual measurement of the load before the load encounters the processing station.

12. The system of claim 1, including an automatic measurement system that measures an actual thickness of the load, and an automatic adjustment system that pre-slows feed in anticipation of the load's arrival at the processing station.

13. The system of claim 1, including a spring-loaded, swinging vane that is pushed by load thickness.

14. The system of claim 13, including a switch actuated by the vane and connected to a feed speed-control circuit that controls the feed path.

15. The system of claim 1, including an automatic measurement system that senses temperature.

16. The system of claim 1, not having a selector knob to control behavior according to material.

17. The system of claim 1, including:

a pair of a first pinch roller and a second pinch roller that squeeze, hold and control the load, wherein the first pinch roller has a fixed axle and the second pinch roller has an axle that floats;

a special gear train by which the rollers are driven so as to always operate at exactly the same speed.

18. An auto-adjusting feeding system for feeding a non-uniform load towards a motor-driven processing station, wherein the load comprises a plurality of items wherein uniformity of the items is not required, comprising:

(a) an undivided moving feed path along which the non-uniform items travel together to the motor-driven processing station;

(b) an automatic measurement system wherein effect of the load on the processing station is measured without human operator intervention during feeding operation, including a non-manual monitoring system by which is monitored whether a motor driving the motor-driven processing station is drawing additional current above a set baseline current amount;

(c) an automatic adjustment system wherein during feeding operation feed of the load is adjusted without human operator intervention, wherein the rate at which the load is fed towards the processing station is non-manually adjusted to be slower or faster based on a non-manual measurement of at least one characteristic of the load.

19. The auto-adjusting feeding system of claim 18, wherein the load characteristic is height, length, width, and/or weight.

20. A mechanical system comprising:

a motor-driven processing station;

an auto-adjusting feeding system for feeding a non-uniform load towards the motor-driven processing station, wherein the load comprises a plurality of items and uniformity of the items is not required, comprising:

(a) an undivided feeding path along which the non-uniform items travel together to the motor-driven processing station;

(b) an automatic measurement system wherein effect of the load on the processing station is measured without human operator intervention during feeding operation; and (c) an automatic adjustment system wherein during feeding operation, feed of the load is adjusted without human operator intervention.

21. The system of claim 20, including an automatic measurement system in which non-manual monitoring is carried out of whether a motor associated with the processing station is drawing additional current above a set baseline current amount.

22. The auto-adjusting feeding system of claim 20, wherein the processing station is motor-driven and the motor speed is non-manually controlled relative to the fed load.

23. The mechanical system of claim 20, wherein the processing station comprises a rotating cutter.

* * * * *